US006371741B1

(12) United States Patent
Wu

(10) Patent No.: US 6,371,741 B1
(45) Date of Patent: Apr. 16, 2002

(54) MANUAL AIR PUMP HAVING AT LEAST TWO SELECTABLE INFLATION MODES

(76) Inventor: Scott Wu, P.O. Box 63-247, Taichung (TW)

( * ) Notice: Subject to any disclaimer, the term of this patent is extended or adjusted under 35 U.S.C. 154(b) by 0 days.

(21) Appl. No.: 09/566,342

(22) Filed: May 8, 2000

(51) Int. Cl.[7] ..... F04B 19/02

(52) U.S. Cl. ..... 417/446; 417/467; 417/468; 417/528

(58) Field of Search ..... 417/446, 467, 417/468, 469, 528

(56) References Cited

U.S. PATENT DOCUMENTS

| | | | | | |
|---|---|---|---|---|---|
| 1,351,847 | A | * | 9/1920 | Gerhart | 417/468 |
| 1,491,388 | A | * | 4/1924 | Foster | 417/468 |
| 1,697,734 | A | * | 1/1929 | Quandt | 417/446 |
| 5,443,370 | A | * | 8/1995 | Wang | 417/469 |
| 5,779,457 | A | * | 7/1998 | Chuang et al. | 417/467 |
| 5,873,705 | A | * | 2/1999 | Chen | 417/467 |
| 5,997,256 | A | * | 12/1999 | Gunther | 417/528 |
| 6,027,319 | A | * | 2/2000 | Winefordner et al. | 417/468 |
| 6,135,733 | A | * | 10/2000 | Wu | 417/467 |
| 6,257,849 | B1 | * | 7/2001 | Wu | 417/468 |

* cited by examiner

*Primary Examiner*—Michael Koczo
(74) *Attorney, Agent, or Firm*—Alan Kamrath; Rider, Bennett, Egan & Arundel, LLP

(57) ABSTRACT

A manual air pump includes an outer cylinder having a first chamber and a head provided to the second end of the outer cylinder. The head includes an outlet passage communicated with the first chamber for supplying air to an object to be inflated. An inner cylinder is securely mounted in the first chamber of the outer cylinder and includes a first end secured in the second end of the outer cylinder and a second end, the inner cylinder defining a second chamber that is communicated with the outlet passage. A piston rod has a first end with a piston slidably received in the first chamber of the outer cylinder and a second end extended beyond the outer cylinder, the piston separating the first chamber into a first chamber section adjacent to the head and a second chamber section distal to the head, the piston rod defining a third chamber therein. A handle is secured to the second end of the piston rod to move therewith. A plug is securely mounted to the second end of the inner cylinder and in sliding contact with an inner periphery defining the third chamber of the piston rod, the plug separating the third chamber into a third chamber section distal to the handle and a fourth chamber section adjacent to the handle, the plug having a one-way valve mounted therein such that air is only flowable from the fourth chamber section into the second chamber. A first release valve is provided for optionally communicating the fourth chamber section with outside and a second release valve is provided for optionally communicating the first chamber section with outside, thereby obtaining high volume/low pressure inflation, medium volume/medium pressure inflation, or low volume/high pressure inflation.

21 Claims, 19 Drawing Sheets

MANUAL AIR PUMP HAVING AT LEAST TWO SELECTABLE INFLATION MODES

BACK GROUND OF THE INVENTION

1. Field of the Invention

The present invention relates to a manual air pump for inflating, e.g., bicycle tires, and more particularly to a dual-mode manual air pump that provides at least two selectable modes for inflation.

2. Description of the Related Art

Bicycle pumps include two typical types: 1) big bore for high volume per stroke and low pressure for rapid inflation, yet high pressure operation is difficult to achieve; and 2) small bore for low volume per stroke and high pressure for inflating bicycle tires to high pressure. Various designs in manual air pumps having selectable high volume and high pressure modes have been proposed, wherein the pump in one mode provides a very high volume of air per pump stroke and in another mode provides less volume per stroke but enables the user to inflate to higher pressures. An example of such manual air pumps is disclosed in U.S. Pat. No. 5,443,370 issued to Wang on Aug. 22, 1995. Yet, there are only two inflation modes provided. The present invention is intended to provide a manual air pump that provides at least two selectable modes for inflation.

SUMMARY OF THE INVENTION

It is an object of the present invention to provide a manual air pump that provides selectable high pressure and high volume modes for inflation.

It is another object of the present invention to provide a manual air pump that provides three selectable inflation modes.

In accordance with a first aspect of the invention, a manual air pump comprises:

an outer cylinder comprising a first chamber and including a first end and a second end, a head provided to the second end of the outer cylinder, the head including an outlet passage communicated with the first chamber for supplying air to an object to be inflated, an inner cylinder securely mounted in the first chamber of the outer cylinder and including a first end secured in the second end of the outer cylinder and a second end, the inner cylinder defining a second chamber that is communicated with the outlet passage, a piston rod having a first end with a piston slidably received in the first chamber of the outer cylinder and a second end extended beyond the outer cylinder, the piston separating the first chamber into a first chamber section adjacent to the head and a second chamber section distal to the head, the piston rod defining a third chamber therein, a handle secured to the second end of the piston rod to move therewith, a plug securely mounted to the second end of the inner cylinder and in sliding contact with an inner periphery defining the third chamber of the piston rod, the plug separating the second chamber into a third chamber section distal to the handle and a fourth chamber section adjacent to the handle, the plug having a one-way valve mounted therein such that air is only flowable from the fourth chamber section into the third chamber, means for supplying ambient air into the second chamber section and the fourth chamber section during an outward stroke of the handle away from the head, and a release valve means for optionally communicating the fourth chamber section with outside, whereby reciprocating movement of the handle causes high volume/low pressure inflation when the release valve means is in an inoperative status such that the fourth chamber section is not communicated with outside, and reciprocating movement of the handle causes low volume/high pressure inflation when the release valve means is in an operative status such that the fourth chamber section is communicated with outside.

In accordance with a second aspect of the invention, a manual air pump comprises:

an outer cylinder comprising a first chamber and including a first end and a second end, a head provided to the second end of the outer cylinder, the head including an outlet passage communicated with the first chamber for supplying air to an object to be inflated, an inner cylinder securely mounted in the first chamber of the outer cylinder and including a first end secured in the second end of the outer cylinder and a second end, the inner cylinder defining a second chamber that is communicated with the outlet passage, a piston rod having a first end with a piston slidably received in the first chamber of the outer cylinder and a second end extended beyond the outer cylinder, the piston separating the first chamber into a first chamber section adjacent to the head and a second chamber section distal to the head, the piston rod defining a third chamber therein, a handle secured to the second end of the piston rod to move therewith, a plug securely mounted to the second end of the inner cylinder and in sliding contact with an inner periphery defining the third chamber of the piston rod, the plug separating the second chamber into a third chamber section distal to the handle and a fourth chamber section adjacent to the handle, the plug having a one-way valve mounted therein such that air is only flowable from the fourth chamber section into the third chamber, means for supplying ambient air into the second chamber section and the fourth chamber section during an outward stroke of the handle away from the head, and a release valve means for optionally communicating the first chamber section with outside, whereby reciprocating movement of the handle causes high volume/low pressure inflation when the release valve means is in an inoperative status such that the first chamber section is not communicated with outside, and reciprocating movement of the handle causes low volume/high pressure inflation when the release valve means is in an operative status such that the first chamber section is communicated with outside.

In accordance with a third aspect of the invention, a manual air pump comprises:

an outer cylinder comprising a first chamber and including a first end and a second end, a head provided to the second end of the outer cylinder, the head including an outlet passage communicated with the first chamber for supplying air to an object to be inflated, an inner cylinder securely mounted in the first chamber of the outer cylinder and including a first end secured in the second end of the outer cylinder and a second end, the inner cylinder defining a second chamber that is communicated with the outlet passage, a piston rod having a first end with a piston slidably received in the first chamber of the outer cylinder and a second end extended beyond the outer cylinder, the piston separating the first chamber into a first chamber section adjacent to the head and a second chamber section distal to the head, the piston rod defining a third chamber therein, a handle secured to the second end of the piston rod to move therewith, a plug securely mounted to the second end of the inner cylinder and in sliding contact with an inner periphery defining the third chamber of the piston rod, the plug separating the second chamber into a third chamber section distal to the handle and a fourth chamber section adjacent to the handle, the plug having a one-way valve mounted therein such that air is only flowable from the fourth chamber section into the third chamber, means for supplying ambient air into the second chamber section and the fourth chamber section during an outward stroke of the handle away from the head, a first release valve means for optionally communicating the fourth chamber section with outside, a second release valve means for optionally communicating the first chamber section with outside, whereby reciprocating movement of the handle causes high volume/low pressure inflation when the first release valve means is in an inoperative status such that the fourth chamber section is not communicated with outside and the second release valve means is in an inoperative status such that the first chamber is not communicated with outside, whereby reciprocating movement of the handle causes medium volume/medium pressure inflation when the first release valve means is in an operative status such that the fourth chamber section is communicated with outside and the second release valve means is in an inoperative status such that the first chamber section is not communicated with outside, and whereby reciprocating movement of the handle causes low volume/high pressure inflation when the first release valve means is in an inoperative status such that the fourth chamber section is not communicated with outside and the second release valve means is in an operative status such that the first chamber section is communicated with outside.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
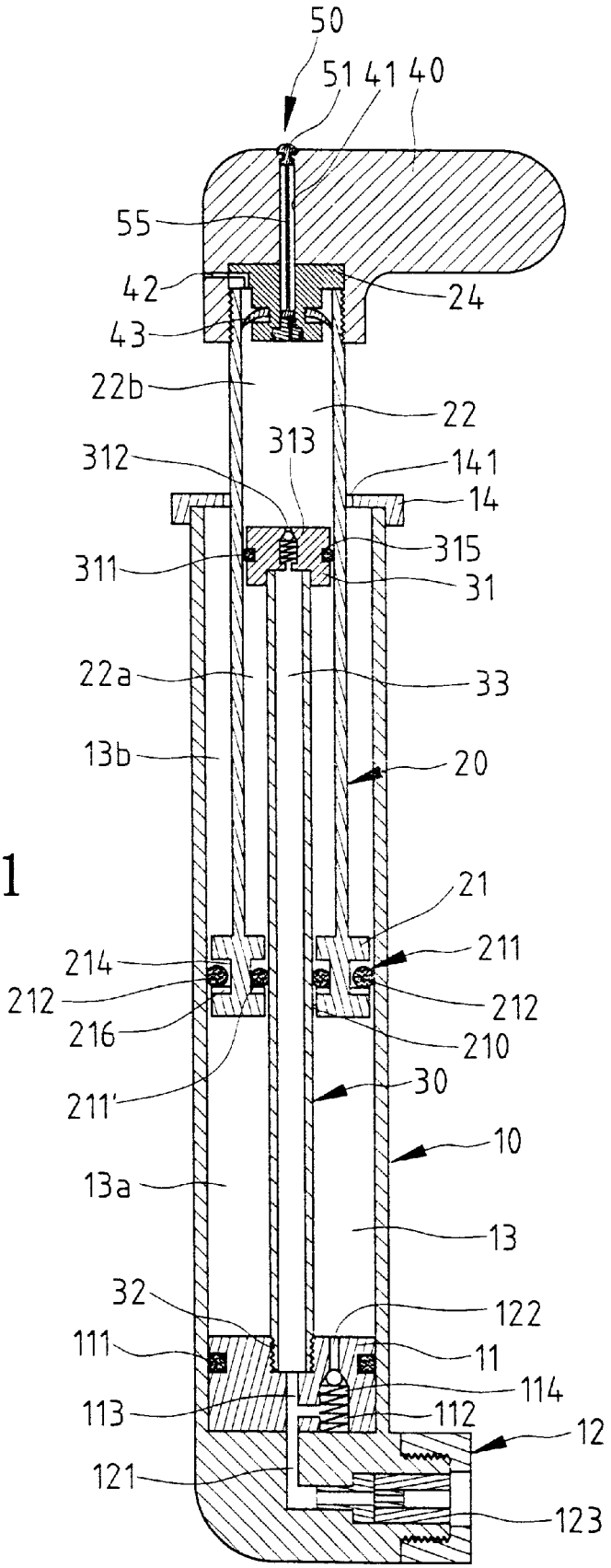
FIG. 1 is a sectional view of a first embodiment of a manual air pump in accordance with the present invention.

Referring to FIG. 1, a manual air pump in accordance with the present invention generally comprises an outer cylinder 10 including a first chamber 13 therein. An end cap 14 is provided to seal an open first end of the first chamber 13 and includes an opening 141 that communicates the first chamber 13 with outside. A head 12 seals a second end of the first chamber 13. The head 12 includes an outlet passage 121 communicated with the first chamber 13 for supplying air to an object to be inflated under control of a valve coupler 123. A block 11 is mounted in the second end of the first chamber 13 and includes a passage 122 for communicating the first chamber 13 with the outlet passage 121. A one-way valve 112 is mounted in an enlarged section 114 of the passage 122 such that air is only flowable from the first chamber 13 to the outlet passage 121. The block 11 further includes a passage 113 for communicating the passage 122 with the outlet passage 121. Of course, the passage 122 can be directly communicated with the outlet passage 121.

The manual air pump further includes an inner cylinder 30 securely mounted in the first chamber 13 of the outer cylinder 10. In this embodiment, a first end 32 of the inner cylinder 30 is in threading engagement with the block 11 such that a second chamber 33 defined in the inner cylinder 30 is communicated with the passage 113. An O-ring 111 is mounted between an outer periphery of the block 11 and an inner periphery of the chamber 13 to provide a sealing effect.

A piston rod 20 is slidably extended through the opening 141 of the end cap 14. The piston rod 20 is hollow and thus defines a third chamber 22 therein. In addition, the piston rod 20 has a first end with a piston 21 slidably received in the first chamber 13 and a second end to which a handle 40 is securely attached. The piston 21 separates the first chamber 13 into a first chamber section 13*a* adjacent to the head 12 and a second chamber section 13*b* distal to the head 12. A plug 31 is mounted to enclose the second end of the inner cylinder 30 and in sliding contact with an inner periphery defining the third chamber 22. The plug 31 separates the third chamber 22 into a third chamber section 22*a* that is distal to the handle 40 and a fourth chamber section 22*b* that is adjacent to the handle 40. The second end of the piston rod 20 includes an end cap 24 mounted thereto, the end cap 24 having a passage 42, which will be described later. The piston rod 20 is slidably extended through the opening 141 of the end cap 14, yet an annular gap (not labeled) is defined between the second piston rod 20 and an inner periphery defining the opening 141 of the end cap 14 to allow entrance of ambient air into the second chamber section 13*b*. It is noted that the piston 21 includes a longitudinal hole 210 through which the inner cylinder 30 extends.

As illustrated in FIG. 1, the plug 31 includes a passage 312 that communicates the chamber 33 with the fourth chamber section 22*b*. A one-way valve 313 is mounted in the passage 312 such that air is only flowable from the fourth chamber section 22*b* into the chamber 33. An O-ring 311 is mounted in an annular groove 315 defined in an outer periphery of the plug.

Figure 4:
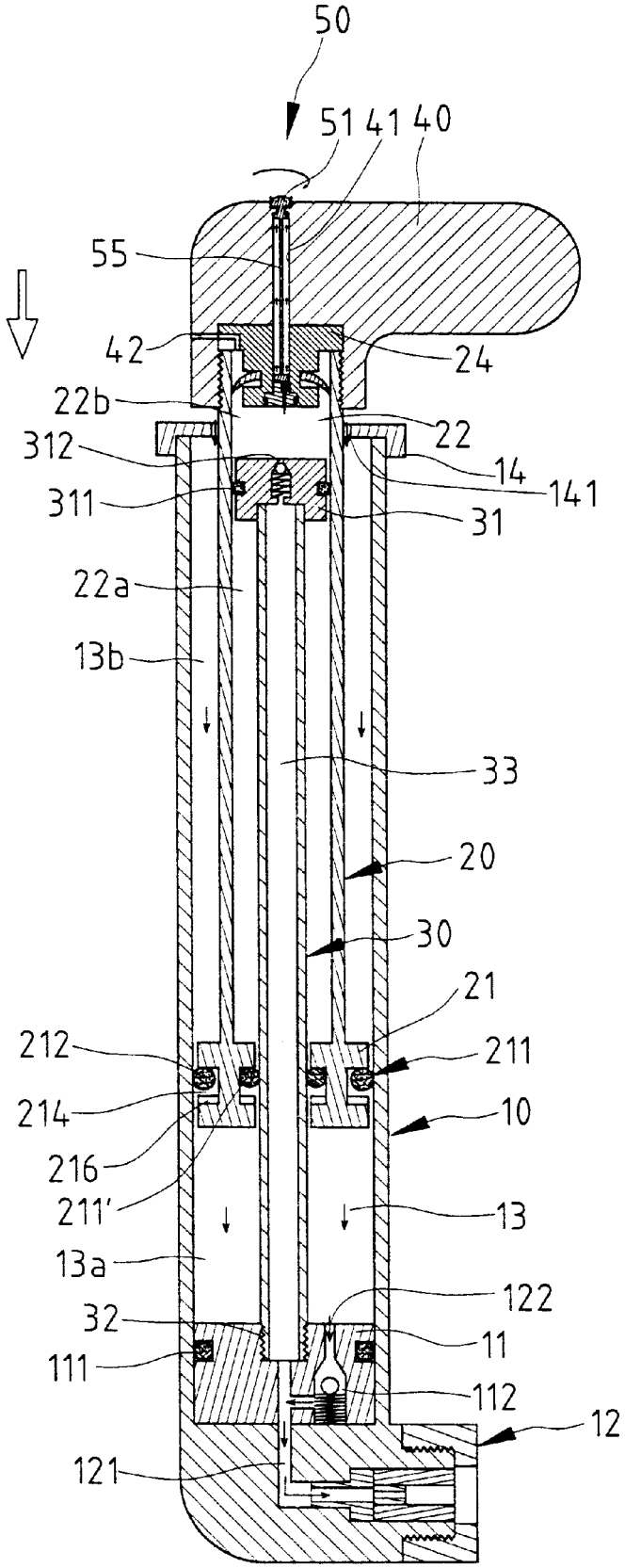
FIG. 4 is a sectional view similar to FIG. 1, wherein the handle of the pump is in an inward stroke for high pressure/low volume pumping.
Figure 7:
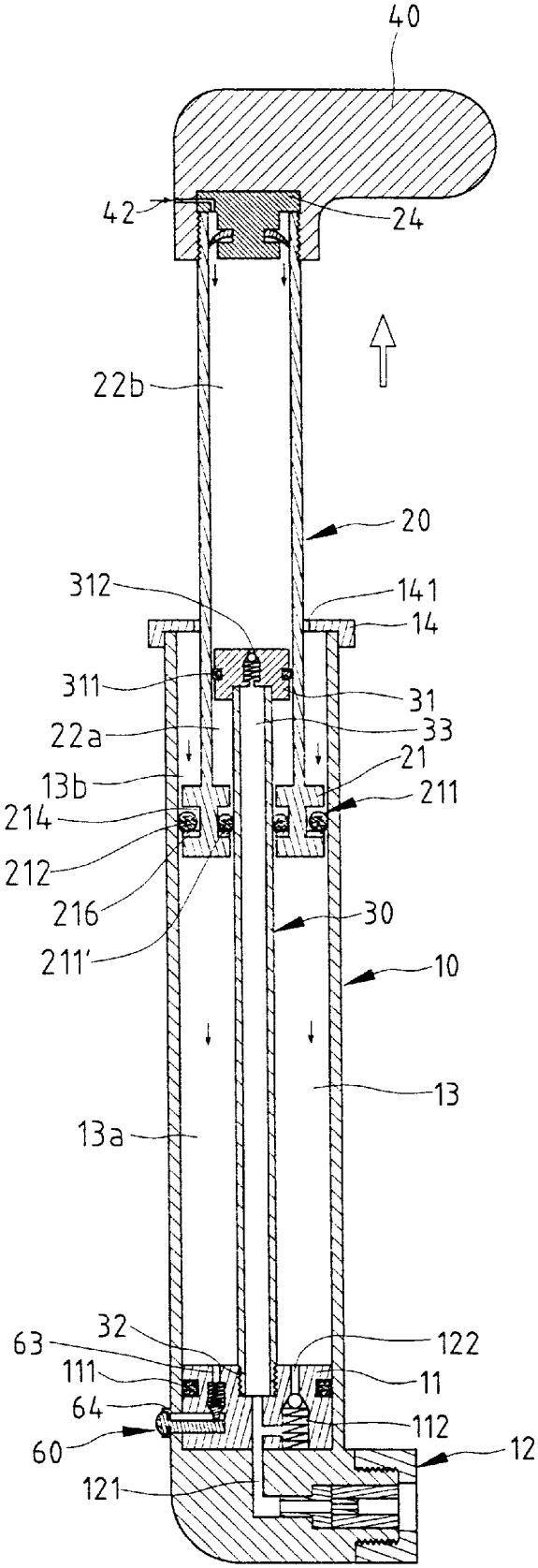
FIG. 7 is a sectional view similar to FIG. 6, wherein the handle of the pump is in an outward stroke for high volume/low pressure pumping.

Still referring to FIG. 1, a one-way air inlet means 211 is mounted in an annular groove 214 defined in an outer periphery of the piston 21. In this embodiment, the one-way air inlet means 211 includes an O-ring 212 mounted in the annular groove 214 that has a notch 216 in an end edge (the lower one in FIG. 1) thereof adjacent to head 12. The O-ring 212 and the annular groove 214 are so arranged that an air path (not labeled) is defined to allow air to flow from the second chamber section 13*b* to the first chamber section 13*a* when the O-ring 212 abuts against the lower end edge of the annular groove 214 and that the air path is blocked (i.e., the first chamber section 13*a* is not communicated with the second chamber section 13*b*) when the O-ring 212 abuts against the other end edge of the annular groove 214. An example of such piston is shown in FIGS. 4 and 7 of U.S. Pat. No. 5,873,705 issued on Feb. 23, 1999, which is incorporated herein for reference. The piston 21 may have a similar arrangement 211' in an inner periphery thereof. Of course, the arrangement 211' may be a simple O-ring to provide a sealing effect between the inner periphery of the piston 21 and the inner cylinder 30.

Figure 3:
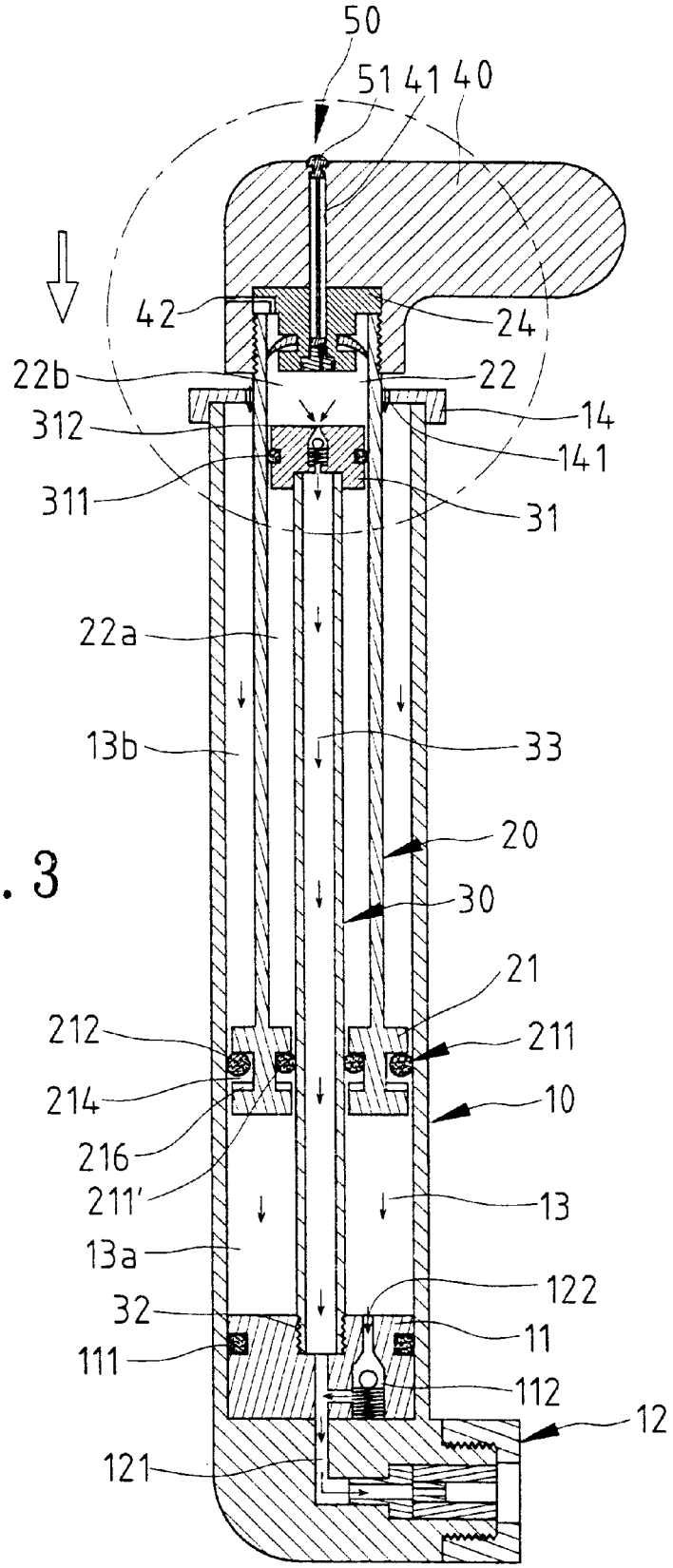
FIG. 3 is a sectional view similar to FIG. 1, wherein the handle of the pump is in an inward stroke for high volume/low pressure pumping.
Figure 3A:
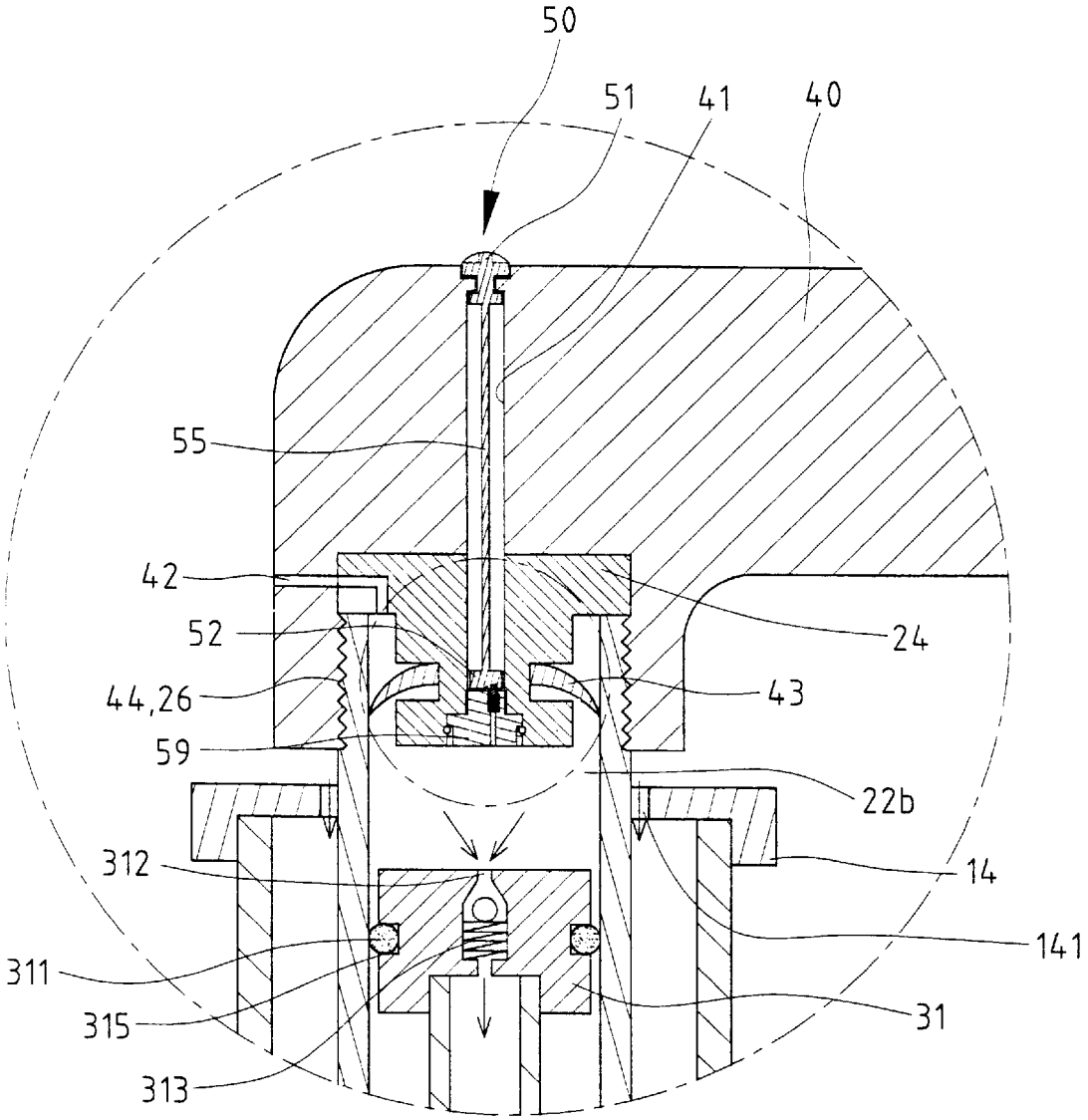
FIG. 3A is an enlarged view of a circle in FIG. 3.
Figure 3B:
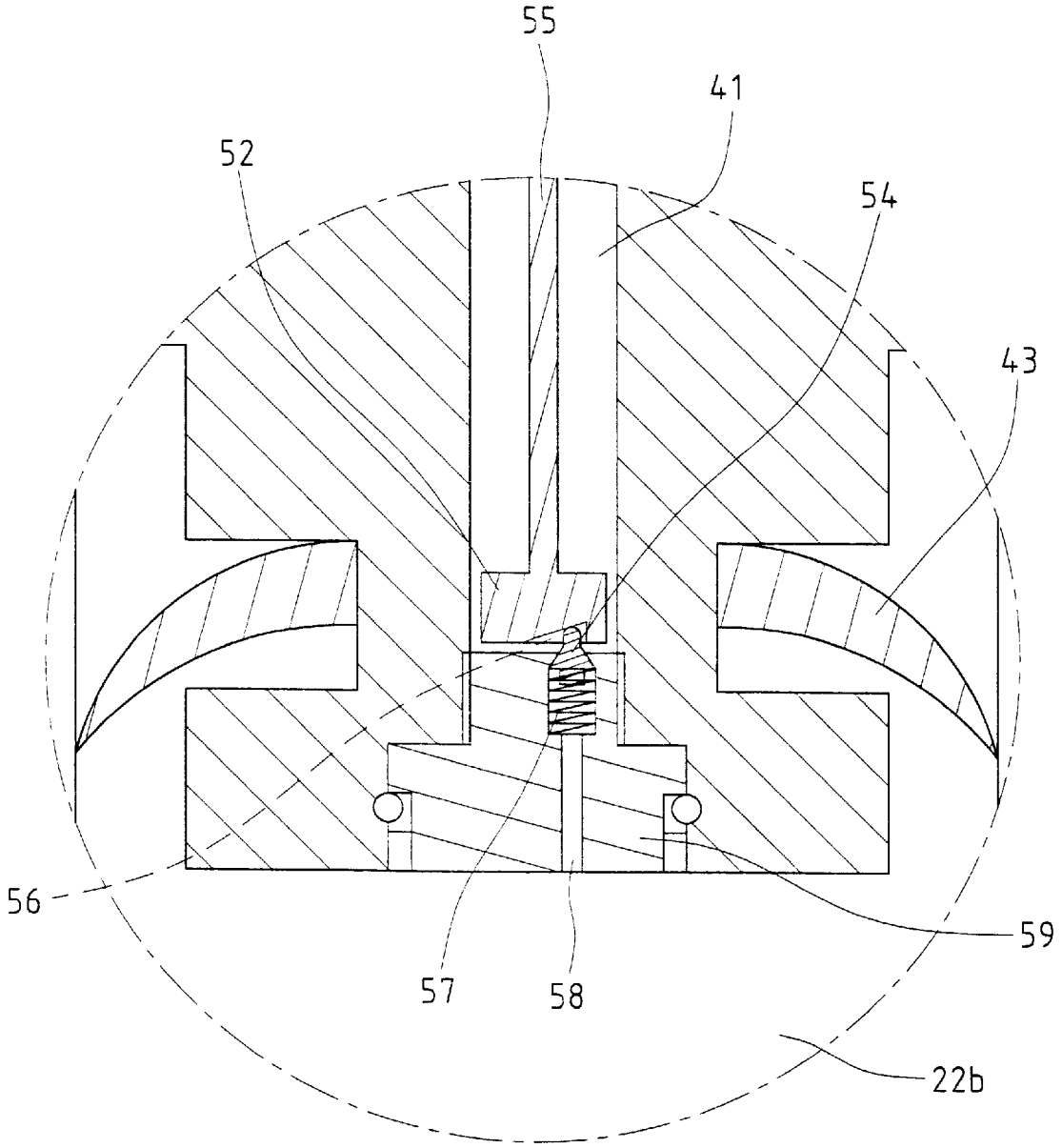
FIG. 3B is an enlarged view of a circle in FIG. 3A.

Referring to FIG. 3A, the handle 40 includes an inner threading 44 and the outer end of the piston rod 20 has an outer threading 26 that is engaged with the inner threading 44 of the handle 40. Air is supplied from outside into the fourth chamber section 22*b* via a passage 42 defined in the handle 40 and the end cap 24. A one-way valve 43 is provided on the end cap 24 such that air is only flowable from outside into the fourth chamber section 22*b*. Still referring to FIG. 3A and further to FIG. 3B, a release valve means 50 is mounted in the handle 40 and the end cap 24. In this embodiment, the release valve means 50 includes a release passage 41 defined in the handle 40 and the end cap 24. A sealing member 59 is mounted to an inner end of the release passage 41 and includes a passage 58 that communicates the release passage 41 with the fourth chamber section 22*b*. The release passage 41 includes an outer end (not labeled) that communicates with outside. A switch rod 55 is mounted in the release passage 41 and includes an outer end 51 partially beyond the handle 40 for manual operation and an inner end 52 adjacent to the sealing member 59. The inner end 52 of the switch rod 55 includes an inclined surface 56 that faces the sealing member 59. A valve 54 is mounted in an enlarged section (not labeled) of the passage 58 and biased by a spring 57 toward the inclined surface 56. The outer end of the release passage 41 and the outer end 51 of the switch rod 55 are so configured that the release passage 41 is blocked when the outer end 51 of the switch rod 55 is in a position shown in FIG. 3A. The release passage 41 is opened when the outer end 51 of the switch rod 55 is switched to a position shown in FIGS. 5 and 5A.

Figure 2:
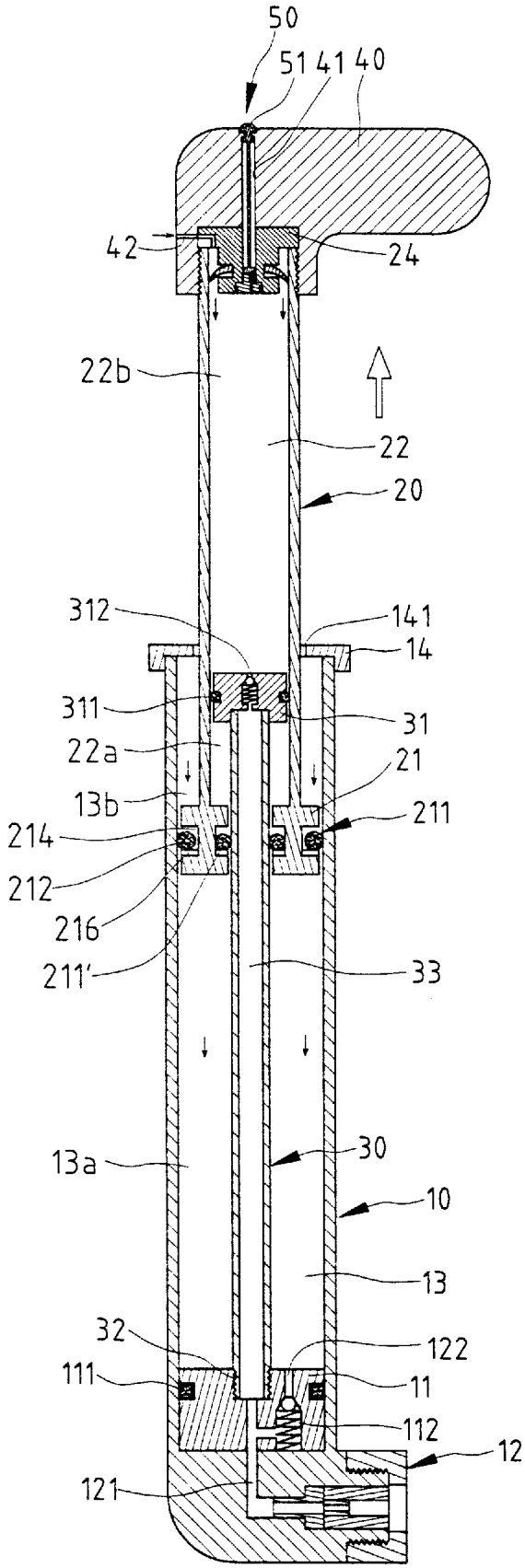
FIG. 2 is a sectional view similar to FIG. 1, wherein the handle of the pump is in an outward stroke for high volume/low pressure pumping.

Referring to FIG. 2, during the outward stroke of the handle 40, O-ring 212 abuts against the lower edge of the annular groove 214 such that air is flowable from chamber section 13*b* to chamber section 13*a*. In addition, vacuum in chamber section 13*a* as a result of a previous inward stroke of the handle 40 assists in intake of air. Any air can in like manner escape from the third chamber section 22*a* into the first chamber section 13*a* by the arrangement 211'. Thus, ambient air enters chamber section 13*a* during the outward stroke of the handle 40. In addition, ambient air enters chamber section 22*b* via passage 42, best shown in FIG. 2.

Referring to FIG. 3, during the inward stroke of the handle 40, the release valve means 50 is in an inoperative status, and the O-ring 212 abuts against the upper edge of the annular groove 214 such that air is not flowable from chamber section 13*a* to chamber section 13*b*. In like manner, air is not flowable from the first chamber section 13*a* to the chamber section 22*a* as a result of the arrangement 211', with any vacuum effect in the chamber section 22*a* being negligible in resisting the inward stroke of the handle 40. Thus, air in chamber section 13*a* is outputted via the passage 122 and the outlet passage 121 in the head 12 during the inward stroke of the handle 40. In addition, air in chamber section 22*b* is outputted via the chamber 33 in the inner cylinder 30 and the outlet passage 121, best shown in FIG. 3. Accordingly, high volume/low pressure inflation is achieved. Ambient air enters chamber section 13*b* during the inward stroke of the handle 40 for subsequent outward stroke of the handle 40.

Figure 5:
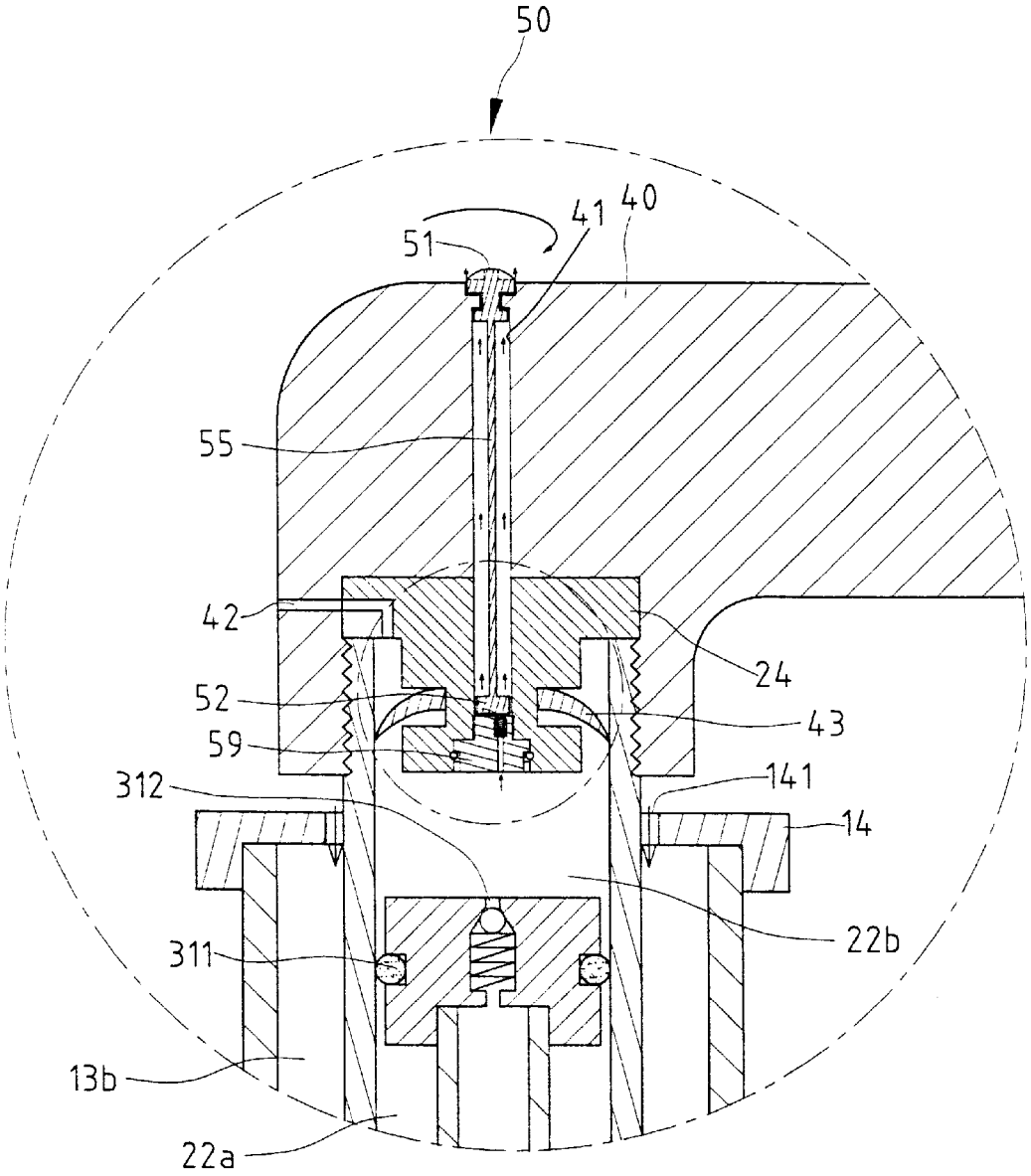
FIG. 5 is an enlarged view of a circle in FIG. 4.
Figure 5A:
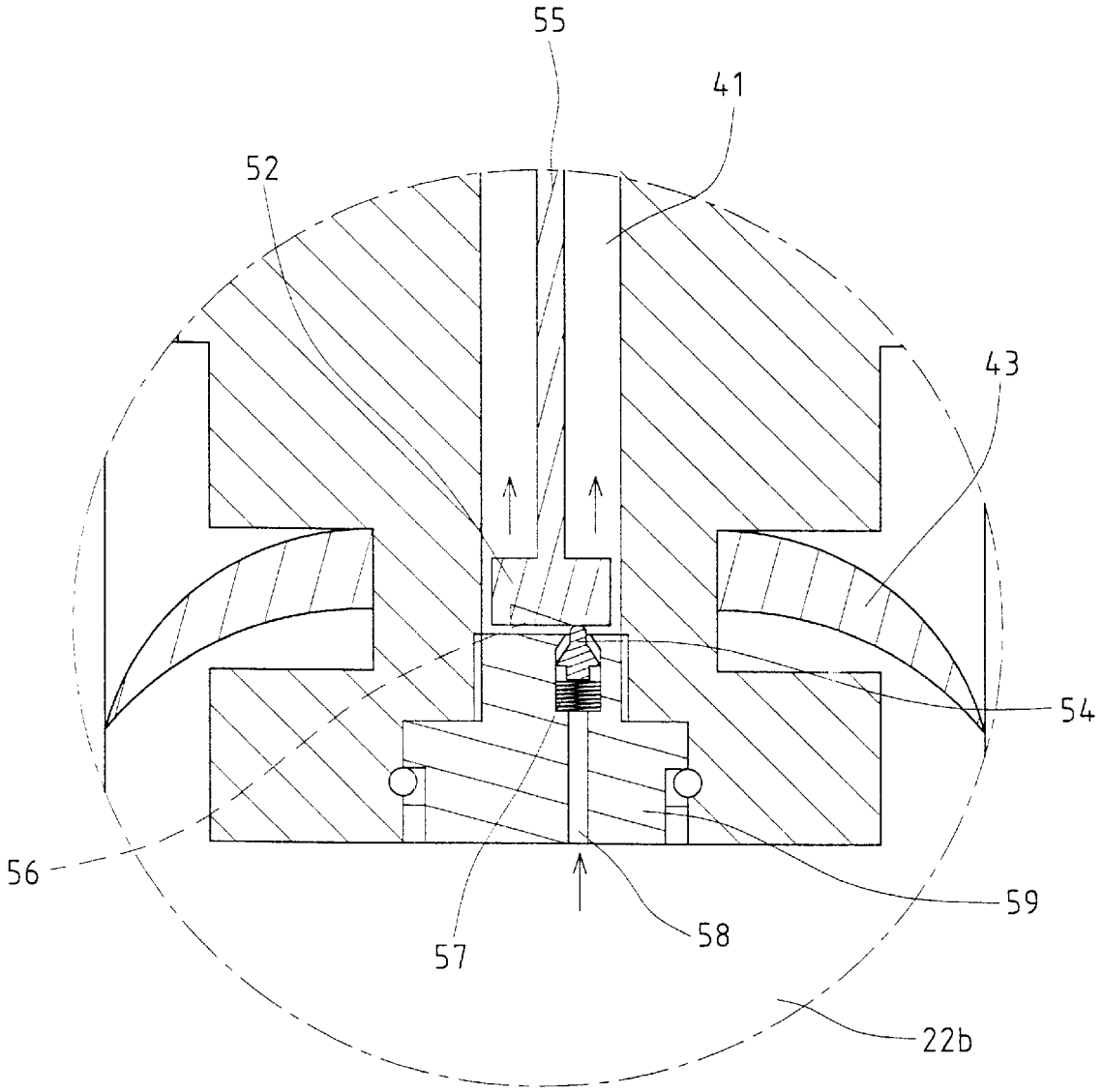
FIG. 5A is an enlarged view of a circle in FIG. 5.

Turning to FIGS. 4, 5, and 5A, when the switch rod 55 of the release valve means 50 is switched to a release status, during the inward stroke of the handle 40, air in the chamber section 22*b* is released via the passage 58 and the release passage 41. Namely, only air in chamber section 13*a* is outputted via the passage 122 and the outlet passage 121 in the head 12 during the inward stroke of the handle 40. Accordingly, low volume/high pressure inflation is achieved. Ambient air enters chamber section 13*b* during the inward stroke of the handle 40 for subsequent outward stroke of the handle 40. Outward stroke of the handle 40 for low volume/high pressure is identical to outward stroke of the handle 40 for high volume/low pressure.

Figure 6:
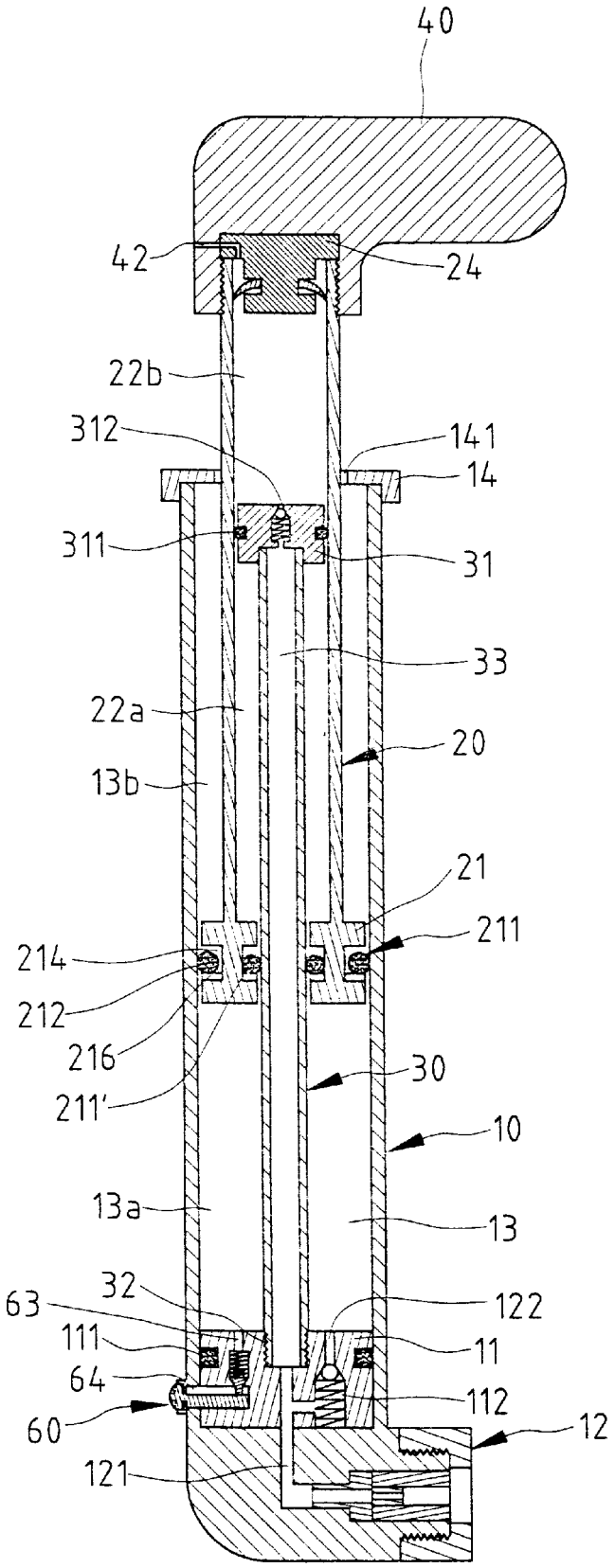
FIG. 6 is a sectional view of a second embodiment of a manual air pump in accordance with the present invention.

FIG. 6 illustrates a second embodiment of the manual air pump in accordance with the present invention, wherein the release valve means 50 in the first embodiment is omitted and a release valve means 60 is mounted to the block 11. In this embodiment, as illustrated in FIGS. 6 and 8A, the release valve means 60 includes a longitudinal release passage 63 and a transverse release passage 64 that are defined in the block 11 and that are communicated with each other for communicating the first chamber section 13*a* with outside. A valve 66 and a spring 65 are mounted in the longitudinal release passage 63. A switch rod 62 is mounted in the transverse release passage 64 and includes an outer end 61 beyond the block 11 for manual operation. The valve 66 includes an end 67 that is in contact with the switch rod 62 under the action of the spring 65. The longitudinal release passage 63 is blocked by the valve 66 when the outer end 61 of the switch rod 62 is in a position shown in FIG. 8A. The longitudinal release passage 63 is opened when the outer end 61 of the switch rod 62 is switched to a position shown in FIGS. 9 and 10 such that air from chamber section 13*a* is released to the environment via the longitudinal release passage 63, a conic passage section 68 that is defined when the end 67 of the valve 66 is moved by the switch rod 62, a transverse hole 69 in the switch rod 62, and the transverse release passage 64.

Referring to FIG. 7, during the outward stroke of the handle 40, O-ring 212 abuts against the lower edge of the annular groove 214 such that air is flowable from chamber section 13*b* to chamber section 13*a*. In addition, vacuum in chamber section 13*a* as a result of a previous inward stroke of the handle 40 assists in intake of air. Any air can in like manner escape from the third chamber section 22*a* into the first chamber section 13*a* by the arrangement 211'. Thus, ambient air enters chamber section 13*a* during the outward stroke of the handle 40. In addition, ambient air enters chamber section 22*b* via passage 42, best shown in FIG. 7.

Figure 8:
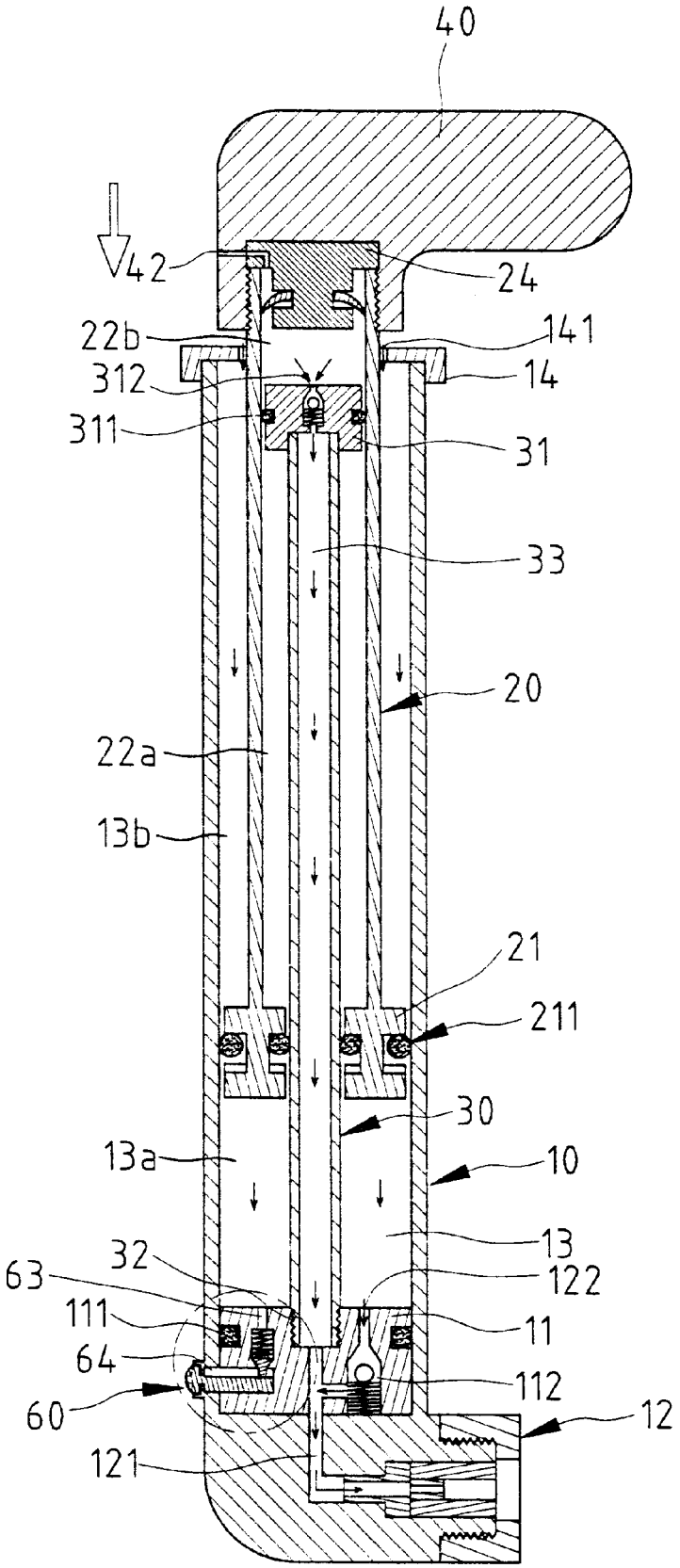
FIG. 8 is a sectional view similar to FIG. 7, wherein the handle of the pump is in an inward stroke for high volume/low pressure pumping.
Figure 8A:
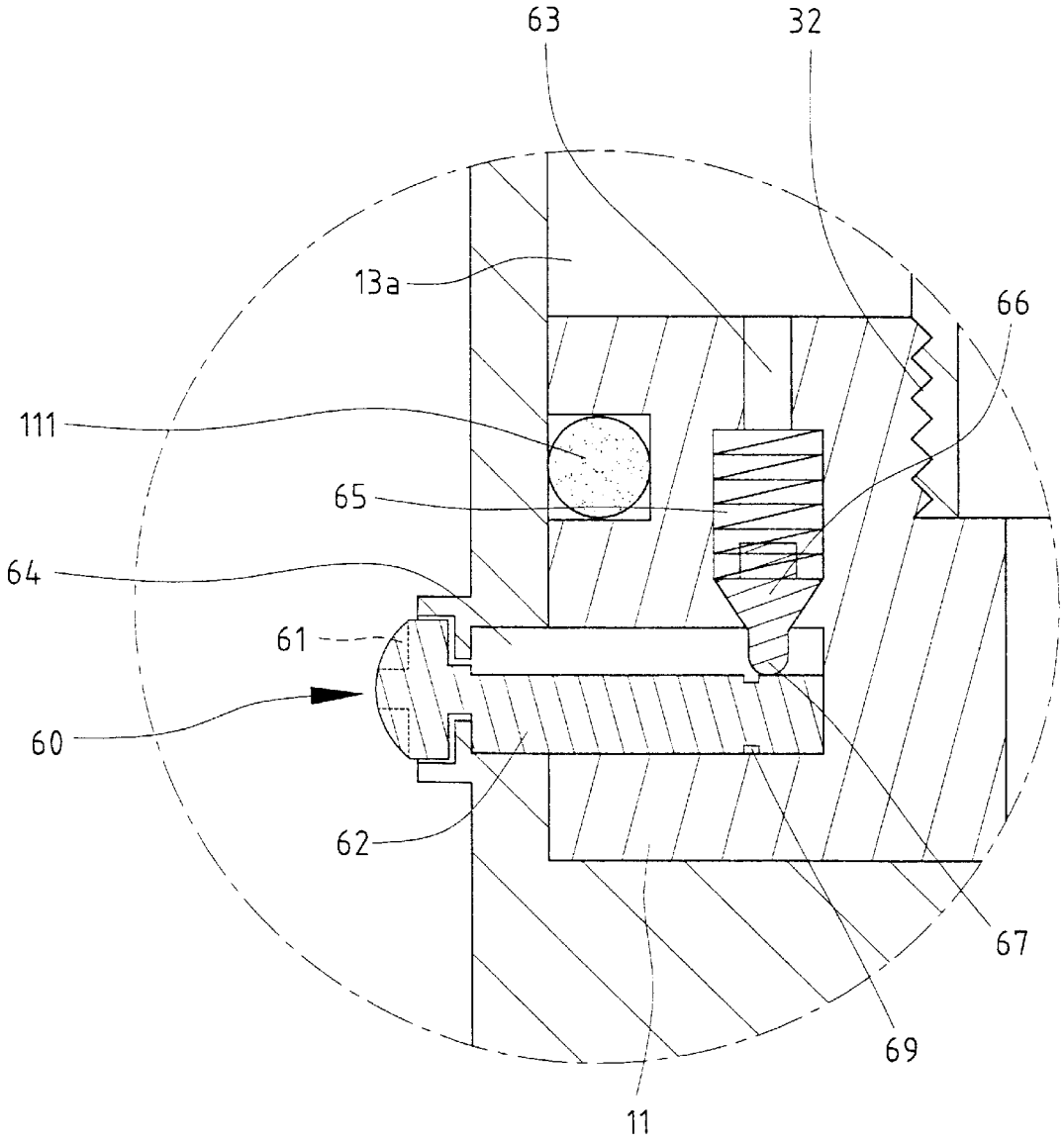
FIG. 8A is an enlarged view of a circle in FIG. 8.

Referring to FIG. 8, during the inward stroke of the handle 40, the release valve means 60 is in an inoperative status, and the O-ring 212 abuts against the upper edge of the annular groove 214 such that air is not flowable from chamber section 13*a* to chamber section 13*b*. In like manner, air is not flowable from the first chamber section 13*a* to the chamber section 22*a* as a result of the arrangement 211', with any vacuum effect in the chamber section 22*a* being negligible in resisting the inward stroke of the handle 40. Thus, air in chamber section 13*a* is outputted via the passage 122 and the outlet passage 121 in the head 12 during the inward stroke of the handle 40. In addition, air in chamber section 22*b* is outputted via the chamber 33 in the inner cylinder 30 and the outlet passage 121, best shown in FIG. 8. Accordingly, high volume/low pressure inflation is achieved. Ambient air enters chamber section 13*b* during the inward stroke of the handle 40 for subsequent outward stroke of the handle 40.

Figure 9:
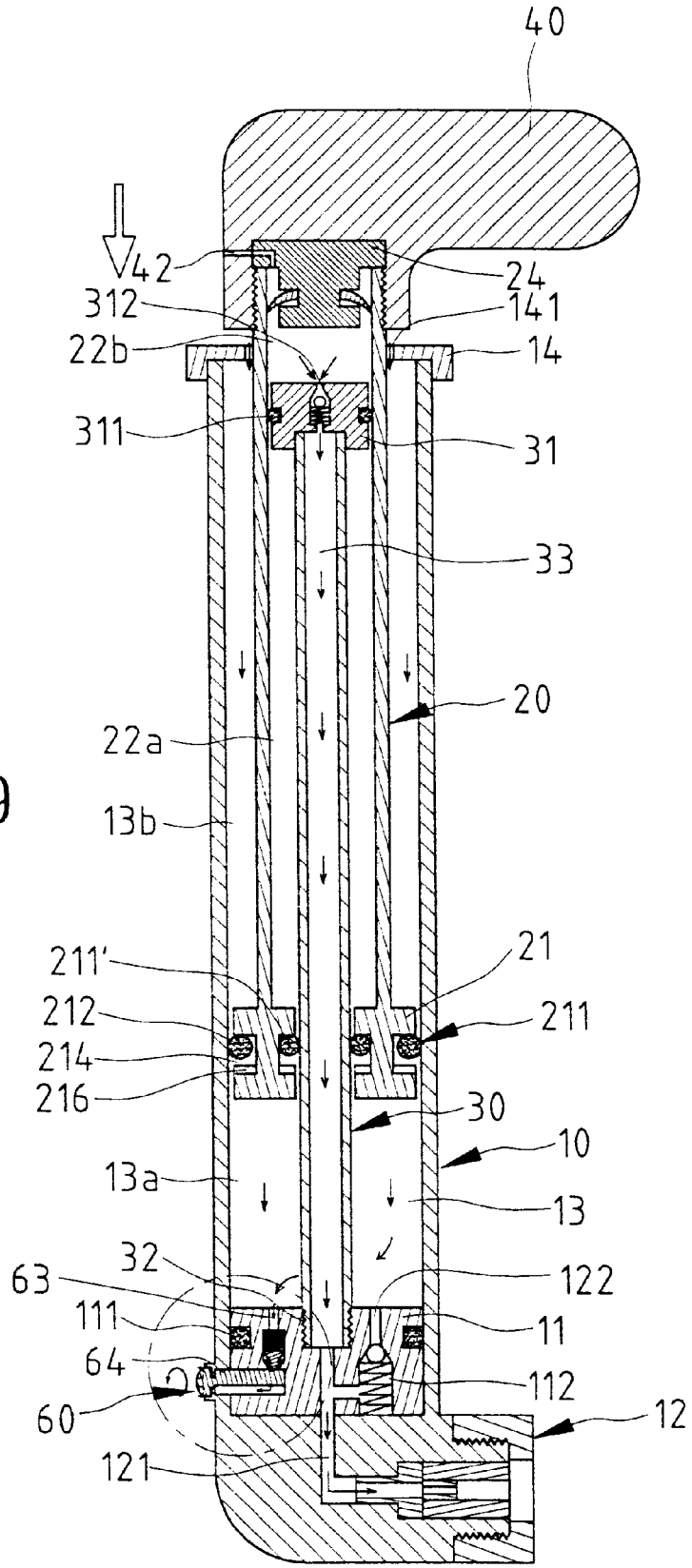
FIG. 9 is a sectional view similar to FIG. 6, wherein the handle of the pump is in an inward stroke for low volume/high pressure pumping.
Figure 10:
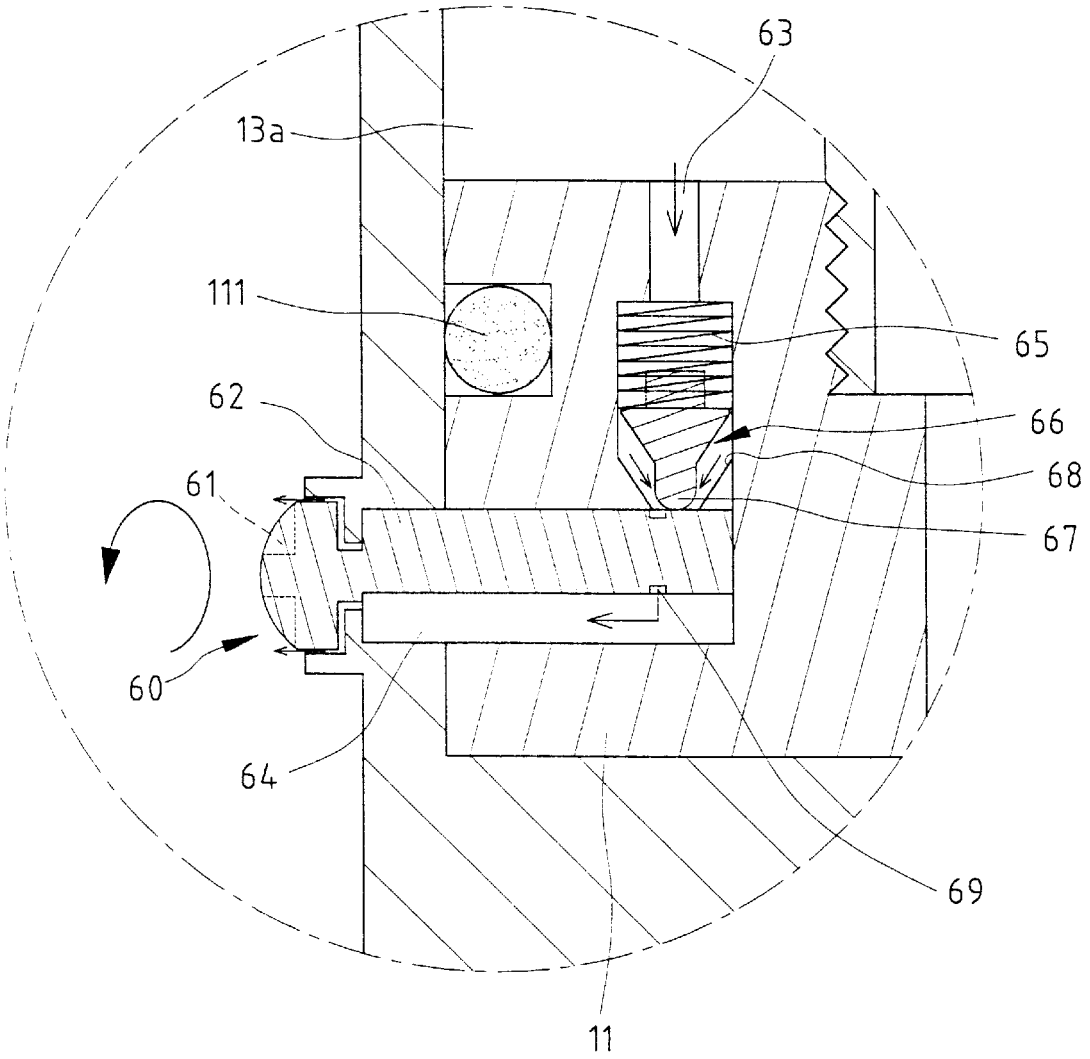
FIG. 10 is an enlarged view of a circle in FIG. 9.

Turning to FIGS. 9 and 10, when the switch rod 62 of the release valve means 60 is switched to a release status, during the inward stroke of the handle 40, air in the chamber section 13*a* is released via the release passages 63 and 64. Namely, only air in chamber 33 is outputted via the outlet passage 121 in the head 12 during the inward stroke of the handle 40. Accordingly, low volume/high pressure inflation is achieved. Ambient air enters chamber section 13*b* during the inward stroke of the handle 40 for subsequent outward stroke of the handle 40. Outward stroke of the handle 40 for low volume/high pressure is identical to outward stroke of the handle 40 for high volume/low pressure.

Figure 11:
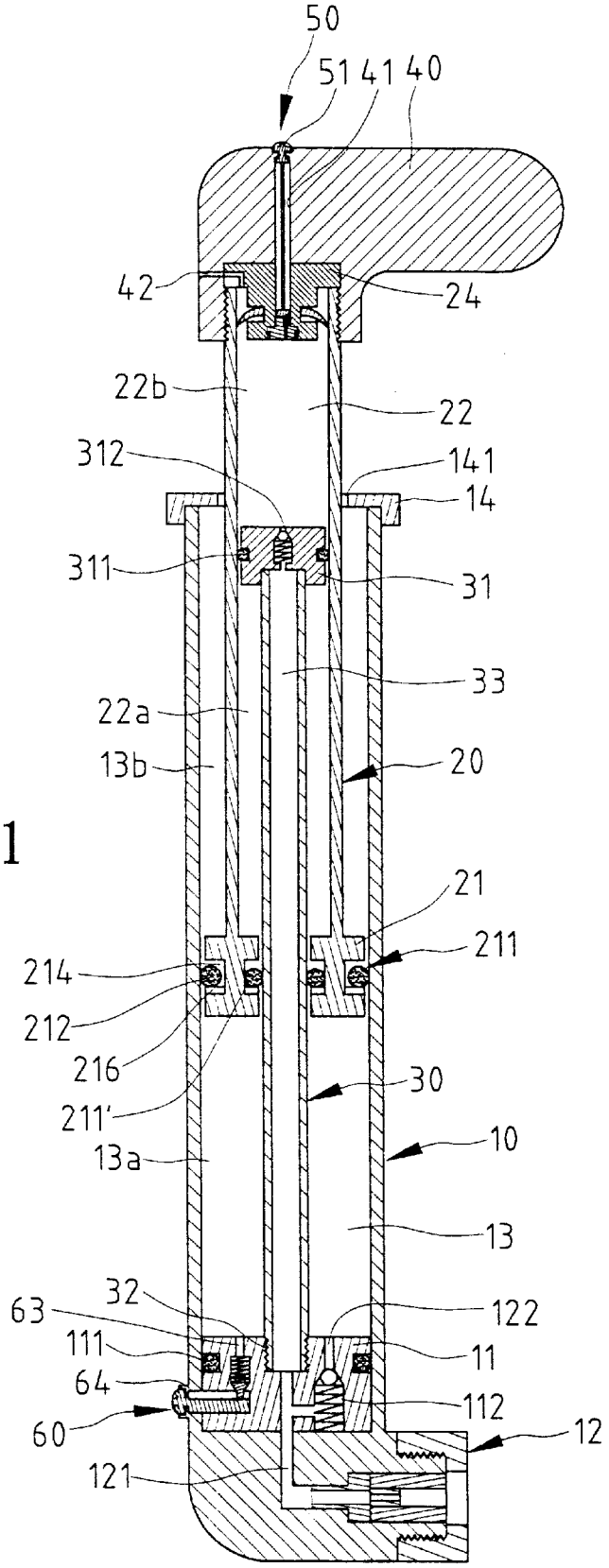
FIG. 11 is a sectional view of a third embodiment of a manual air pump in accordance with the present invention.

FIG. 11 illustrates a third embodiment of the manual air pump in accordance with the present invention, wherein the valve release means 50 in the first embodiment and the valve release means 60 in the second embodiment are both used.

Figure 12:
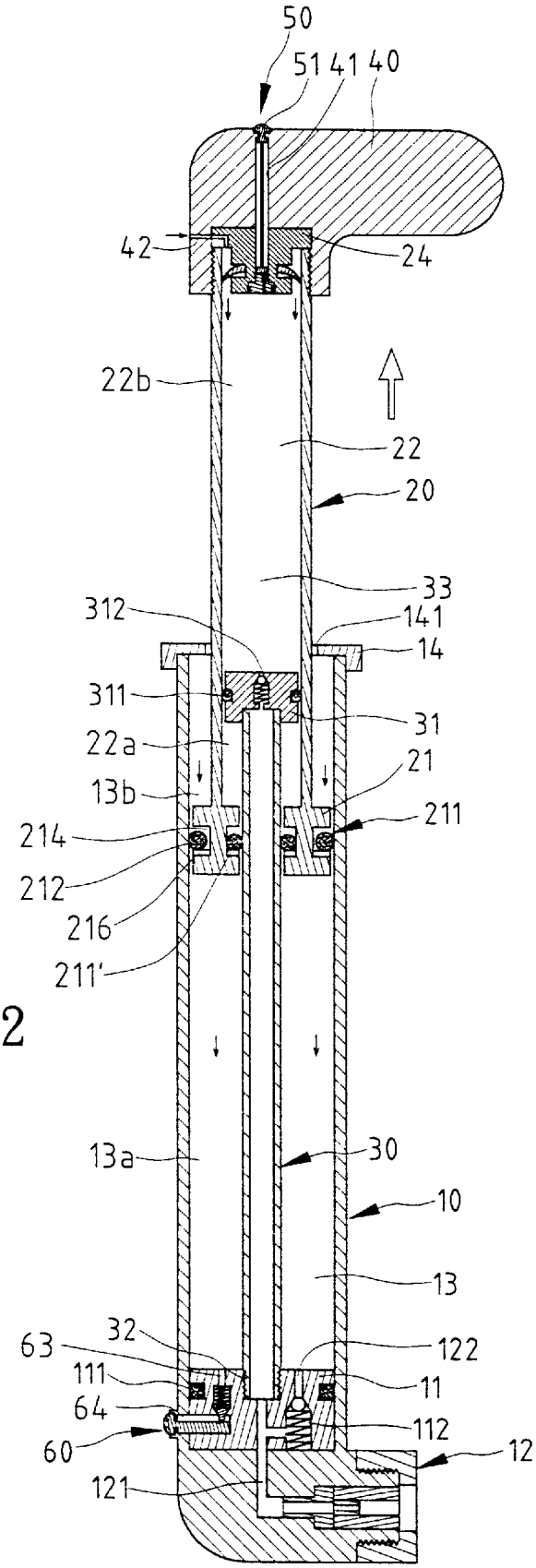
FIG. 12 is a sectional view similar to FIG. 11, wherein the handle of the pump is in an outward stroke for high volume/low pressure pumping.

Referring to FIG. 12, during the outward stroke of the handle 40, O-ring 212 abuts against the lower edge of the annular groove 214 such that air is flowable from chamber section 13*b* to chamber section 13*a*. In addition, vacuum in chamber section 13*a* as a result of a previous inward stroke of the handle 40 assists in intake of air. Any air can in like manner escape from the third chamber section 22*a* into the first chamber section 13*a* by the arrangement 211'. Thus, ambient air enters chamber section 13*a* during the outward stroke of the handle 40. In addition, ambient air enters chamber section 22*b* via passage 42, best shown in FIG. 12.

Figure 13:
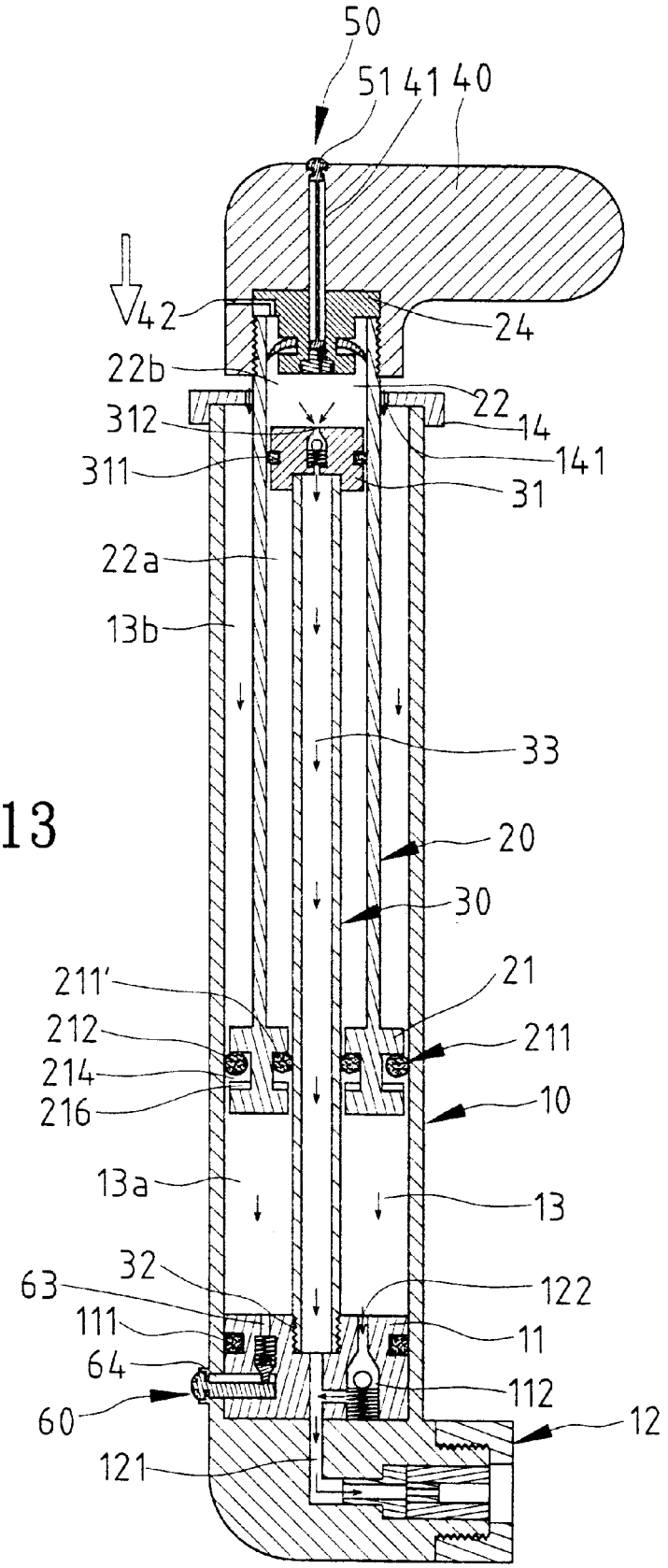
FIG. 13 is a sectional view similar to FIG. 11, wherein the handle of the pump is in an inward stroke for high volume/low pressure pumping.

Referring to FIG. 13, during the inward stroke of the handle 40, the release valve means 50 and 60 are both in their inoperative statuses, and the O-ring 212 abuts against the upper edge of the annular groove 214 such that air is not flowable from chamber section 13*a* to chamber section 13*b*. In like manner, air is not flowable from the first chamber section 13*a* to the chamber section 22*a* as a result of the arrangement 211', with any vacuum effect in the chamber section 22*a* being negligible in resisting the inward stroke of the handle 40. Thus, air in chamber section 13*a* is outputted via the passage 122 and the outlet passage 121 in the head 12 during the inward stroke of the handle 40. In addition, air in chamber section 22*b* is outputted via the chamber 33 in the inner cylinder 30 and the outlet passage 121, best shown in FIG. 13. Accordingly, high volume/low pressure inflation is achieved. Ambient air enters chamber section 13*b* during the inward stroke of the handle 40 for subsequent outward stroke of the handle 40.

Figure 14:
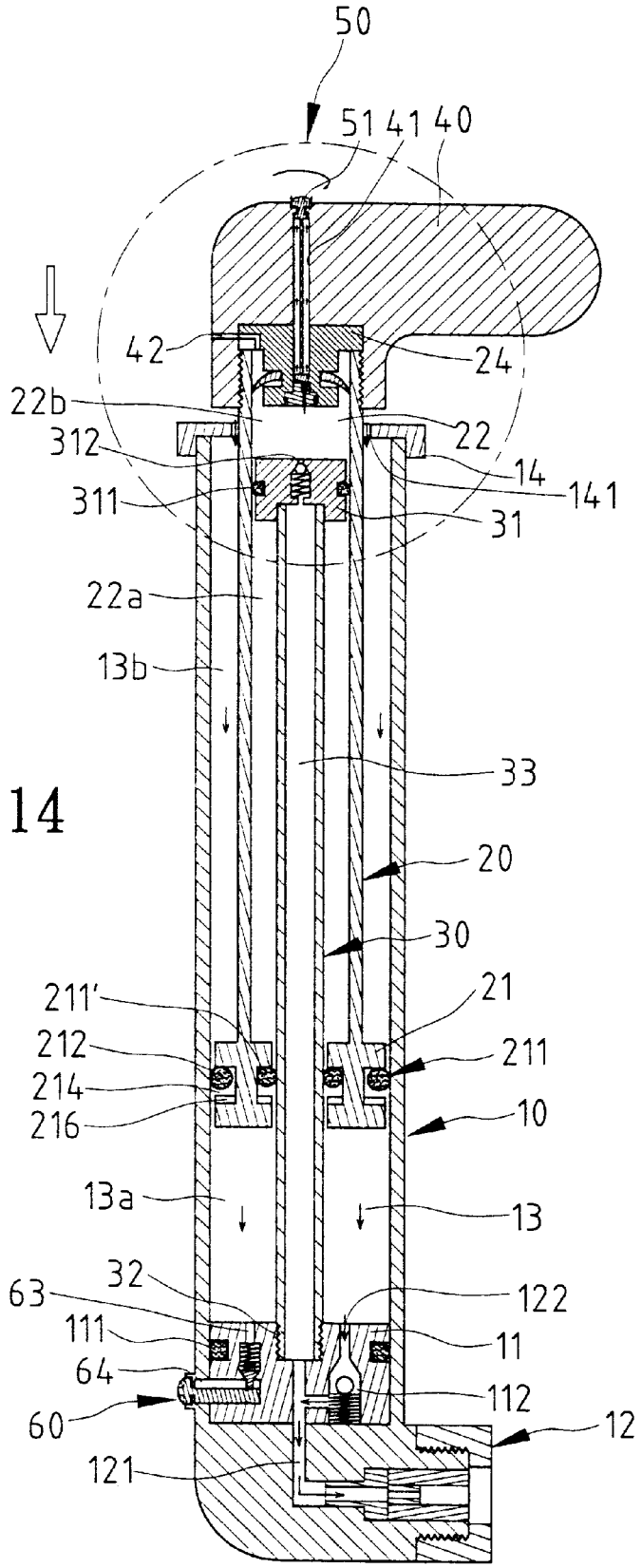
FIG. 14 is a sectional view similar to FIG. 11, wherein the handle of the pump is in an inward stroke for medium volume/medium pressure pumping.

Turning to FIG. 14, when the switch rod 55 of the release valve means 50 is switched to a release status and the release valve means 60 is still in an inoperative status, during the inward stroke of the handle 40, air in the chamber section 22*b* is released via the passage 58 and the release passage 41. Namely, only air in chamber section 13*a* is outputted via the passage 122 and the outlet passage 121 in the head 12 during the inward stroke of the handle 40. Accordingly, medium volume/medium pressure inflation is achieved. Ambient air enters chamber section 13*b* during the inward stroke of the handle 40 for subsequent outward stroke of the handle 40. Outward stroke of the handle 40 for medium volume/medium pressure is identical to outward stroke of the handle 40 for high volume/low pressure.

Figure 15:
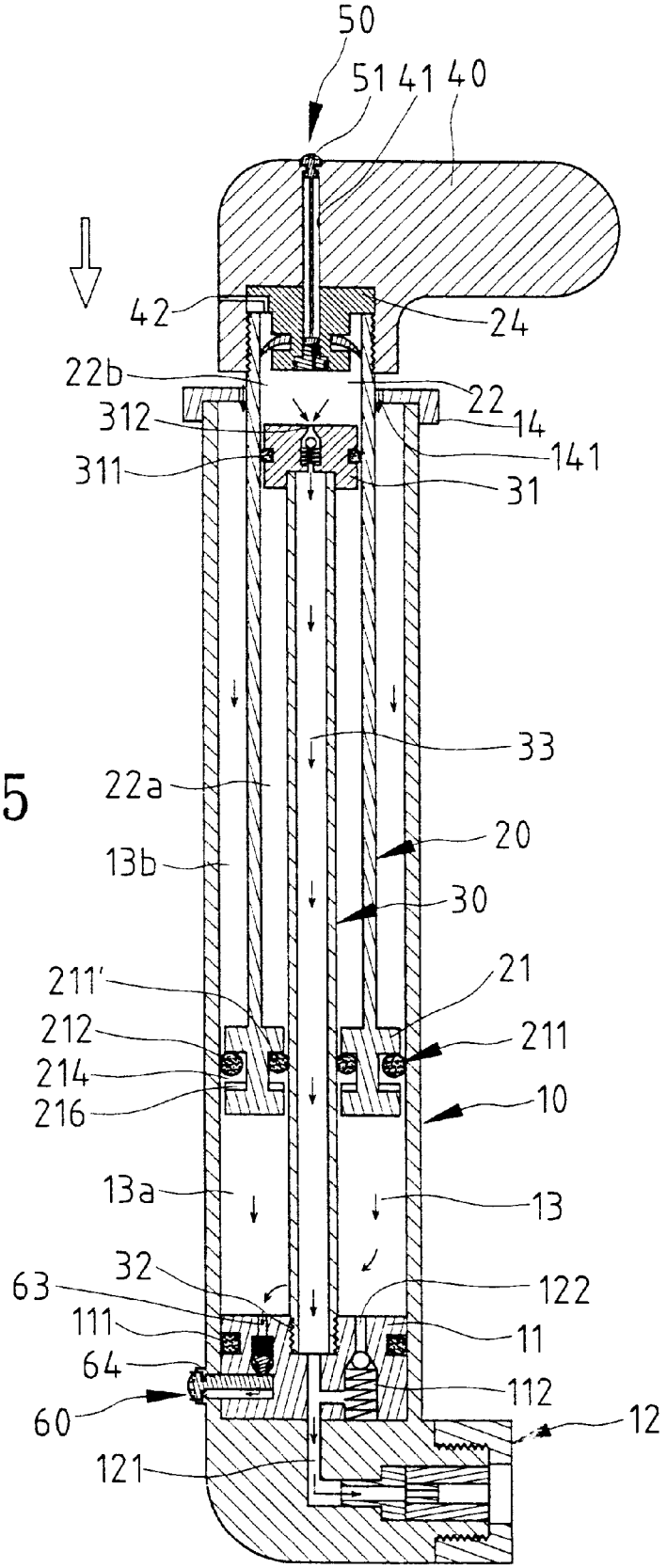
FIG. 15 is a sectional view similar to FIG. 11, wherein the handle of the pump is in an inward stroke for low volume/high pressure pumping.

Turning to FIG. 15, when the release valve means 60 is switched to its operative status and the release valve means 50 is in an inoperative status, during the inward stroke of the handle 40, air in the chamber section 13*a* is released via the release passages 63 and 64. Namely, only air in chamber section 22*b* is outputted via the chamber 33 and the outlet passage 121 in the head 12 during the inward stroke of the handle 40. Accordingly, low volume/high pressure inflation is achieved. Ambient air enters chamber section 13*b* during the inward stroke of the handle 40 for subsequent outward stroke of the handle 40. Outward stroke of the handle 40 for low volume/high pressure is identical to outward stroke of the handle 40 for high volume/low pressure.

According to the above description, a reliable three-mode manual air pump is provided, and operation therefor is simple and easy.

Although the invention has been explained in relation to its preferred embodiment, it is to be understood that many other possible modifications and variations can be made without departing from the spirit and scope of the invention as hereinafter claimed.

What is claimed is:

1. A manual air pump comprising:

an outer cylinder comprising a first chamber and including a first end and a second end, a head provided to the second end of the outer cylinder, the head including an outlet passage communicated with the first chamber for supplying air to an object to be inflated, an inner cylinder securely mounted in the first chamber of the outer cylinder and including a first end secured in the second end of the outer cylinder and a second end, the inner cylinder defining a second chamber that is communicated with the outlet passage, a piston rod having a first end with a piston slidably received in the first chamber of the outer cylinder and a second end extended beyond the outer cylinder, the piston separating the first chamber into a first chamber section adjacent to the head and a second chamber section distal to the head, the piston rod defining a third chamber therein, a handle secured to the second end of the piston rod to move therewith, a plug securely mounted to the second end of the inner cylinder and in sliding contact with an inner periphery defining the third chamber of the piston rod, the plug separating the third chamber into a third chamber section distal to the handle and a fourth chamber section adjacent to the handle, the plug having a one-way valve mounted therein such that air is only flowable from the fourth chamber section into the second chamber, means for supplying ambient air into the first chamber section and the fourth chamber section during an outward stroke of the handle away from the head, and a release valve means for optionally communicating the fourth chamber section with outside, whereby reciprocating movement of the handle causes high volume/low pressure inflation when the release valve means is in an inoperative status such that the fourth chamber section is not communicated with outside, and reciprocating movement of the handle causes low volume/high pressure inflation when the release valve means is in an operative status such that the fourth chamber section is communicated with outside.

2. The manual air pump as claimed in claim 1, wherein the supplying means includes a one-way air inlet means arranged on the piston such that air is only flowable from the second chamber section to the first chamber section when the handle is in its outward stroke.

3. The manual air pump as claimed in claim 2, wherein the piston includes an annular groove defined in an outer periphery thereof, the annular groove including a first end edge and a second end edge, an O-ring being mounted in the annular groove and so arranged that an air path is defined to allow air to flow from the second chamber section to the first chamber section when the O-ring abuts against the first end edge of the annular groove as a result of the outward stroke of the handle away from the head and that the air path is blocked when the O-ring abuts against the second end edge of the annular groove as a result of an inward stroke of the handle toward the head.

4. The manual air pump as claimed in claim 1, wherein the first end of the outer cylinder includes an end cap having an opening through which the piston rod extends, a gap being defined between the piston rod and an inner periphery defining the opening of the end cap for supplying ambient air into the second chamber section.

5. The manual air pump as claimed in claim 1, wherein the second end of the piston rod includes an end cap mounted thereto, with the supplying means including a passage in the end cap for supplying ambient air into the fourth chamber section.

6. The manual air pump as claimed in claim 5, wherein the end cap includes a one-way valve such that air is only flowable from outside into the fourth chamber section.

7. The manual air pump as claimed in claim 5, wherein the release valve means is mounted in the end cap.

8. The manual air pump as claimed in claim 7, wherein the release valve means includes:

a release passage in the end cap for communicating the fourth chamber section with outside, a sealing member mounted in the release passage and including a passage for communicating the release passage with the fourth chamber section, a valve and a spring being mounted in the passage of the sealing member, a switch rod mounted in the release passage and including an inner end adjacent to the sealing member and an outer end beyond the end cap for manual operation, the inner end of the switch rod including an inclined surface that faces the sealing member, the valve being biased by the spring toward the inclined surface of the inner end of the switch rod, the switch rod being switchable between a first inoperative position in which the fourth chamber section is not communicated with outside and a second operative position in which the fourth chamber section is communicated with outside.

9. A manual air pump comprising:

an outer cylinder comprising a first chamber and including a first end and a second end, a head provided to the second end of the outer cylinder, the head including an outlet passage communicated with the first chamber for supplying air to an object to be inflated, an inner cylinder securely mounted in the first chamber of the outer cylinder and including a first end secured in the second end of the outer cylinder and a second end, the inner cylinder defining a second chamber that is communicated with the outlet passage, a piston rod having a first end with a piston slidably received in the first chamber of the outer cylinder and a second end extended beyond the outer cylinder, the piston separating the first chamber into a first chamber section adjacent to the head and a second chamber section distal to the head, the piston rod defining a third chamber therein, a handle secured to the second end of the piston rod to move therewith, a plug securely mounted to the second end of the inner cylinder and in sliding contact with an inner periphery defining the third chamber of the piston rod, the plug separating the third chamber into a third chamber section distal to the handle and a fourth chamber section adjacent to the handle, the plug having a one-way valve mounted therein such that air is only flowable from the fourth chamber section into the second chamber, means for supplying ambient air into the first chamber section and the fourth chamber section during an outward stroke of the handle away from the head, and a release valve means for optionally communicating the first chamber section with outside, whereby reciprocating movement of the handle causes high volume/low pressure inflation when the release valve means is in an inoperative status such that the first chamber section is not communicated with outside, and reciprocating movement of the handle causes low volume/high pressure inflation when the release valve means is in an operative status such that the first chamber section is communicated with outside, wherein the supplying means includes a one-way air inlet means arranged on the piston such that air is only flowable from the second chamber section to the first chamber section when the handle is in its outward stroke.

10. The manual air pump as claimed in claim 9, Wherein the piston includes an annular groove defined in an outer periphery thereof, the annular groove including a first end edge and a second end edge, an O-ring being mounted in the annular groove and so arranged that an air path is defined to allow air to flow from the second chamber section to the first chamber section when the O-ring abuts against the first end edge of the annular groove as a result of the outward stroke of the handle away from the head and that the air path is blocked when the O-ring abuts against the second end edge of the annular groove as a result of an inward stroke of the handle toward the head.

11. The manual air pump as claimed in claim 9, wherein the second end of the outer cylinder includes a block mounted therein, the block including a passage for communicating the first chamber section with the outlet passage in the head, a one-way valve being mounted in the passage of the block such that air is only flowable from the first chamber to the outlet passage.

12. A manual air pump comprising:

an outer cylinder comprising a first chamber and including a first end and a second end, a head provided to the second end of the outer cylinder, the head including an outlet passage communicated with the first chamber for supplying air to an object to be inflated, an inner cylinder securely mounted in the first chamber of the outer cylinder and including a first end secured in the second end of the outer cylinder and a second end, the inner cylinder defining a second chamber that is communicated with the outlet passage, a piston rod having a first end with a piston slidably received in the first chamber of the outer cylinder and a second end extended beyond the outer cylinder, the piston separating the first chamber into a first chamber section adjacent to the head and a second chamber section distal to the head, the piston rod defining a third chamber therein, a handle secured to the second end of the piston rod to move therewith, a plug securely mounted to the second end of the inner cylinder and in sliding contact with an inner periphery defining the third chamber of the piston rod, the plug separating the third chamber into a third chamber section distal to the handle and a fourth chamber section adjacent to the handle, the plug having a one-way valve mounted therein such that air is only flowable from the fourth chamber section into the second chamber, means for supplying ambient air into the first chamber section and the fourth chamber section during an outward stroke of the handle away from the head, and a release valve means for optionally communicating the first chamber section with outside, whereby reciprocating movement of the handle causes high volume/low pressure inflation when the release valve means is in an inoperative status such that the first chamber section is not communicated with outside, and reciprocating movement of the handle causes low volume/high pressure inflation when the release valve means is in an operative status such that the first chamber section is communicated with outside, wherein the first end of the outer cylinder includes an end cap having an opening through which the piston rod extends, a gap being defined between the piston rod and an inner periphery defining the opening of the end cap for supplying ambient air into the second chamber section.

13. A manual air pump comprising:

an outer cylinder comprising a first chamber and including a first end and a second end, a head provided to the second end of the outer cylinder, the head including an outlet passage communicated with the first chamber for supplying air to an object to be inflated, an inner cylinder securely mounted in the first chamber of the outer cylinder and including a first end secured in the second end of the outer cylinder and a second end, the inner cylinder defining a second chamber that is communicated with the outlet passage, a piston rod having a first end with a piston slidably received in the first chamber of the outer cylinder and a second end extended beyond the outer cylinder, the piston separating the first chamber into a first chamber section adjacent to the head and a second chamber section distal to the head, the piston rod defining a third chamber therein, a handle secured to the second end of the piston rod to move therewith, a plug securely mounted to the second end of the inner cylinder and in sliding contact with an inner periphery defining the third chamber of the piston rod, the plug separating the third chamber into a third chamber section distal to the handle and a fourth chamber section adjacent to the handle, the plug having a one-way valve mounted therein such that air is only flowable from the fourth chamber section into the second chamber, means for supplying ambient air into the first chamber section and the fourth chamber section during an outward stroke of the handle away from the head, and a release valve means for optionally communicating the first chamber section with outside, whereby reciprocating movement of the handle causes high volume/low pressure inflation when the release valve means is in an inoperative status such that the first chamber section is not communicated with outside, and reciprocating movement of the handle causes low volume/high pressure inflation when the release valve means is in an operative status such that the first chamber section is communicated with outside, wherein the second end of the piston rod includes an end cap mounted thereto, with the supplying means including a passage in the end cap for supplying ambient air into the fourth chamber section.

14. The manual air pump as claimed in claim 13, wherein the end cap includes a one-way valve such that air is only flowable from outside into the fourth chamber section.

15. A manual air pump comprising:

an outer cylinder comprising a first chamber and including a first end and a second end, a head provided to the second end of the outer cylinder, the head including an outlet passage communicated with the first chamber for supplying air to an object to be inflated, an inner cylinder securely mounted in the first chamber of the outer cylinder and including a first end secured in the second end of the outer cylinder and a second end, the inner cylinder defining a second chamber that is communicated with the outlet passage, a piston rod having a first end with a piston slidably received in the first chamber of the outer cylinder and a second end extended beyond the outer cylinder, the piston separating the first chamber into a first chamber section adjacent to the head and a second chamber section distal to the head, the piston rod defining a third chamber therein, a handle secured to the second end of the piston rod to move therewith, a plug securely mounted to the second end of the inner cylinder and in sliding contact with an inner periphery defining the third chamber of the piston rod, the plug separating the third chamber into a third chamber section distal to the handle and a fourth chamber section adjacent to the handle, the plug having a one-way valve mounted therein such that air is only flowable from the fourth chamber section into the second chamber, means for supplying ambient air into the first chamber section and the fourth chamber section during an outward stroke of the handle away from the head, and a release valve means for optionally communicating the first chamber section with outside, whereby reciprocating movement of the handle causes high volume/low pressure inflation when the release valve means is in an inoperative status such that the first chamber section is not communicated with outside, and reciprocating movement of the handle causes low volume/high pressure inflation when the release valve means is in an operative status such that the first chamber section is communicated with outside, wherein the second end of the outer cylinder includes a block mounted therein, the block including a passage for communicating the first chamber section with the outlet passage in the head, a one-way valve being mounted in the passage of the block such that air is only flowable from the first chamber to the outlet passage, and wherein the release valve means is mounted in the block and includes:

a longitudinal release passage and a transverse release passage that are defined in the block and that are communicated with each other for communicating the first chamber section with outside, a valve mounted in the longitudinal release passage, and a switch rod mounted in the transverse release passage and including an outer end beyond the block for manual operation, wherein the longitudinal release passage is blocked by the valve when the outer end of the switch rod is in a first inoperative position, and wherein the longitudinal release passage is opened when the outer end of the switch rod is in a second operative position such that air from the first chamber section is released to the environment via the longitudinal release passage and the transverse release passage.

16. A manual air pump comprising:

an outer cylinder comprising a first chamber and including a first end and a second end, a head provided to the second end of the outer cylinder, the head including an outlet passage communicated with the first chamber for supplying air to an object to be inflated, an inner cylinder securely mounted in the first chamber of the outer cylinder and including a first end secured in the second end of the outer cylinder and a second end, the inner cylinder defining a second chamber that is communicated with the outlet passage, a piston rod having a first end with a piston slidably received in the first chamber of the outer cylinder and a second end extended beyond the outer cylinder, the piston separating the first chamber into a first chamber section adjacent to the head and a second chamber section distal to the head, the piston rod defining a third chamber therein, a handle secured to the second end of the piston rod to move therewith, a plug securely mounted to the second end of the inner cylinder and in sliding contact with an inner periphery defining the third chamber of the piston rod, the plug separating the third chamber into a third chamber section distal to the handle and a fourth chamber section adjacent to the handle, the plug having a one-way valve mounted therein such that air is only flowable from the fourth chamber section into the second chamber, means for supplying ambient air into the first chamber section and the fourth chamber section during an outward stroke of the handle away from the head, a first release valve means for optionally communicating the fourth chamber section with outside, a second release valve means for optionally communicating the first chamber section with outside, whereby reciprocating movement of the handle causes high volume/low pressure inflation when the first release valve means is in an inoperative status such that the fourth chamber section is not communicated with outside and the second release valve means is in an inoperative status such that the first chamber is not communicated with outside, whereby reciprocating movement of the handle causes medium volume/medium pressure inflation when the first release valve means is in an operative status such that the fourth chamber section is communicated with outside and the second release valve means is in an inoperative status such that the first chamber section is not communicated with outside, and whereby reciprocating movement of the handle causes low volume/high pressure inflation when the first release valve means is in an inoperative status such that the fourth chamber section is not communicated with outside and the second release valve means is in an operative status such that the first chamber section is communicated with outside.

17. The manual air pump as claimed in claim 16, wherein the second end of the outer cylinder includes a block mounted therein, the block including a passage for communicating the first chamber section with the outlet passage in the head, a one-way valve being mounted in the passage of the block such that air is only flowable from the first chamber to the outlet passage.

18. The manual air pump as claimed in claim 17, wherein the second release valve means is mounted in the block and includes:

a longitudinal release passage and a transverse release passage that are defined in the block and that are communicated with each other for communicating the first chamber section with outside, a valve mounted in the longitudinal release passage, and a switch rod mounted in the transverse release passage and including an outer end beyond the block for manual operation, wherein the longitudinal release passage is blocked by the valve when the outer end of the switch rod is in a first inoperative position, and wherein the longitudinal release passage is opened when the outer end of the switch rod is in a second operative position such that air from the first chamber section is released to the environment via the longitudinal release passage and the transverse release passage.

19. The manual air pump as claimed in claim 16, wherein the second end of the piston rod includes an end cap mounted thereto, with the supplying means including a passage in the end cap for supplying ambient air into the fourth chamber section.

20. The manual air pump as claimed in claim 19, wherein the end cap includes a one-way valve such that air is only flowable from outside into the fourth chamber section.

21. The manual air pump as claimed in claim 19, wherein the first release valve means is mounted in the end cap and includes:

a release passage in the end cap for communicating the fourth chamber section with outside, a sealing member mounted in the release passage and including a passage for communicating the release passage with the fourth chamber section, a valve and a spring being mounted in the passage of the sealing member, a switch rod mounted in the release passage and including an inner end adjacent to the sealing member and an outer end beyond the end cap for manual operation, the inner end of the switch rod including an inclined surface that faces the sealing member, the valve being biased by the spring toward the inclined surface of the inner end of the switch rod, the switch rod being switchable between a first inoperative position in which the fourth chamber section is not communicated with outside and a second operative position in which the fourth chamber section is communicated with outside.

* * * * *